United States Patent [19]

Börjesson et al.

[11] 4,200,251

[45] Apr. 29, 1980

[54] DEVICE FOR A SIGHT

[75] Inventors: Jan Börjesson; Bertil Eriksson, both of Karlskoga, Sweden

[73] Assignee: Aktiebolaget Bofors, Bofors, Sweden

[21] Appl. No.: 847,385

[22] Filed: Oct. 31, 1977

[30] Foreign Application Priority Data

Nov. 5, 1976 [SE] Sweden ..... 7612354

[51] Int. Cl.[2] ..... F41G 7/12

[52] U.S. Cl. ..... 244/3.13; 250/330

[58] Field of Search ..... 244/3.13, 3.16; 250/330

[56] References Cited

U.S. PATENT DOCUMENTS

| | | | |
|---|---|---|---|
| 3,544,217 | 12/1970 | McEntyre | 244/3.16 |
| 3,598,344 | 8/1971 | Walters et al. | 244/3.11 |
| 3,672,607 | 6/1972 | Stauff et al. | 244/3.16 |
| 3,820,742 | 6/1974 | Watkins | 244/3.16 |
| 4,020,339 | 4/1977 | Gustafson | 244/3.13 |

*Primary Examiner*—Charles T. Jordan

*Attorney, Agent, or Firm*—Pollock, Vande Sande & Priddy

[57] ABSTRACT

An apparatus for viewing a target and directing a laser guide beam at the target. A movable scanning mirror is employed to direct the laser guide beam at the target and to direct visible light from the target to an optical sight for viewing a corresponding image of the target. The scanning mirror also reflects infrared radiation from the target to an infrared receiver that generates corresponding electrical signals to produce a visible image of the infrared radiation of the target on a cathode ray tube. A symbol generating means is provided to generate an alignment mark for the imaged infrared radiation. The relative position of the alignment mark with respect to the image of the infrared radiation is determined by the position of the movable scanning mirror and the associated axis of the guide beam. The image of the infrared radiation and the associated infrared alignment mark are passed to the optical sight for viewing in order to aid in directing the laser guide beam at the target under conditions of reduced visibility.

16 Claims, 3 Drawing Figures

DEVICE FOR A SIGHT

Figure 1:
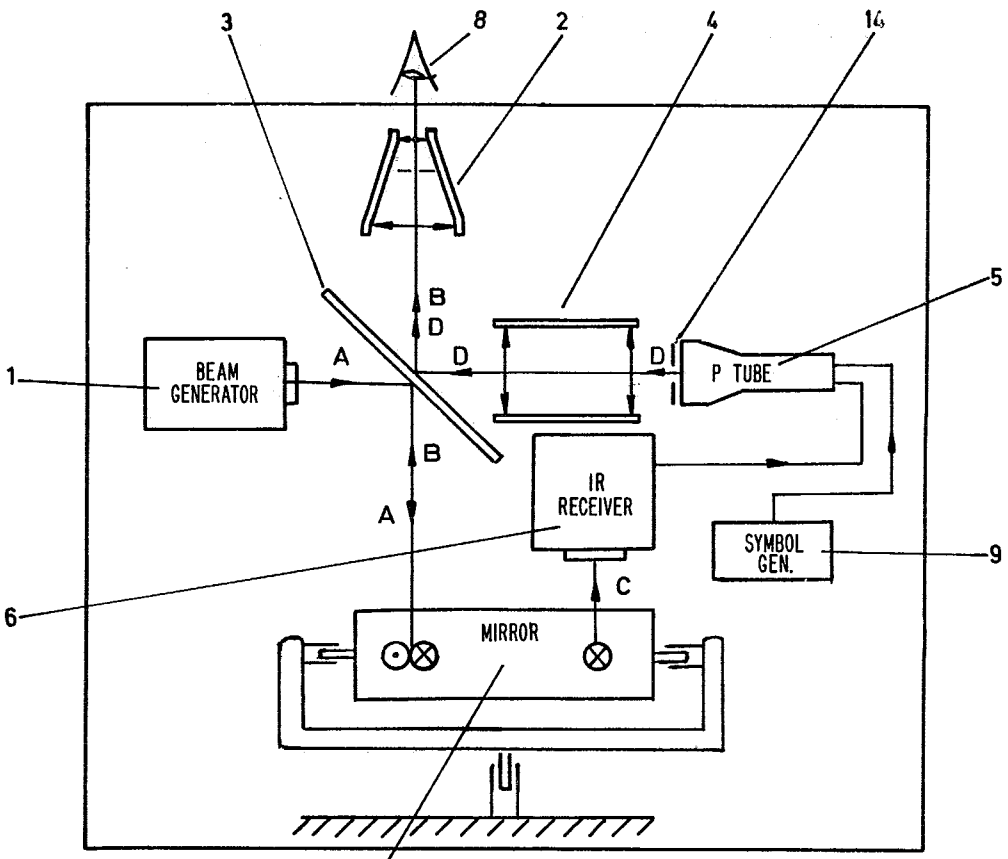

The present invention relates to a device for a system for determining the deviation of an object from a reference line defined by the line of sight in a device for determining the position of a target comprising members for transmitting a beam of rays, a receiver unit which comprises a ray detector influenced by the beam of rays for generating an electric output signal modulated in dependence on the beam of rays and members for evaluation of the position of the object relative to the line of sight.

The invention is particularly intended for use for optical guidance beam control of a missile against a moving target. It is then previously known to transmit a beam of rays by means of a beam transmitting device set up in the launching site for the missile or its immediate vicinity, the centre axis of the beam of rays then constantly being kept directed against the moving target by turning the beam transmitting device. The missile is provided with a ray detector which is sensitive to the radiation in the beam of rays, which is arranged to be influenced by the radiation in the beam of rays and to generate an electric signal corresponding to this. The beam of rays is then particularly formed in such a way that in a plane at right angles to the line of sight it forms a predetermined geometrical pattern which also moves in a predetermined way relative to the line of sight. The radiation pattern of the beam of rays can e.g. consist of narrow radiation bands which sweep periodically and alternatingly back and forth over the line of sight, the times when the radiation bands pass the missile then constituting a measure of its position.

As the system is based upon the beam of rays constantly being kept directed towards the target, it must be possible to observe the target with a target tracking member, e.g. an optical sight or an automatic target tracker. An optical system then has limited use in darkness, smoke and fog.

In order to amplify the signal from a target, it has previously been proposed to connect a light amplifier in the optical system, thereby increasing the possibility of observing the target. However, the practical realization of such a device involves considerable difficulties, for which no satisfactory solution has been found. Thus, it has proved that the image from the light amplifier contains a considerable number of disturbances, especially those generated by the missile itself.

The purpose of the present invention is therefore primarily to achieve a device which makes it possible to determine the deviation of an object from the line of sight to a target even when the visible image of the target and its background is limited by e.g. darkness, fog or smoke. The characterizing feature of the device according to the invention is then that it comprises an IR (infra-red) sight with members for generating an aiming symbol and accurate adjustment of this relative to the axis of symmetry of the beam of rays. An alternative embodiment of the invention also comprises members for guiding the aiming symbol or the image presented in the IR sight, in dependence on the direction of the guidance beam.

Figure 2:
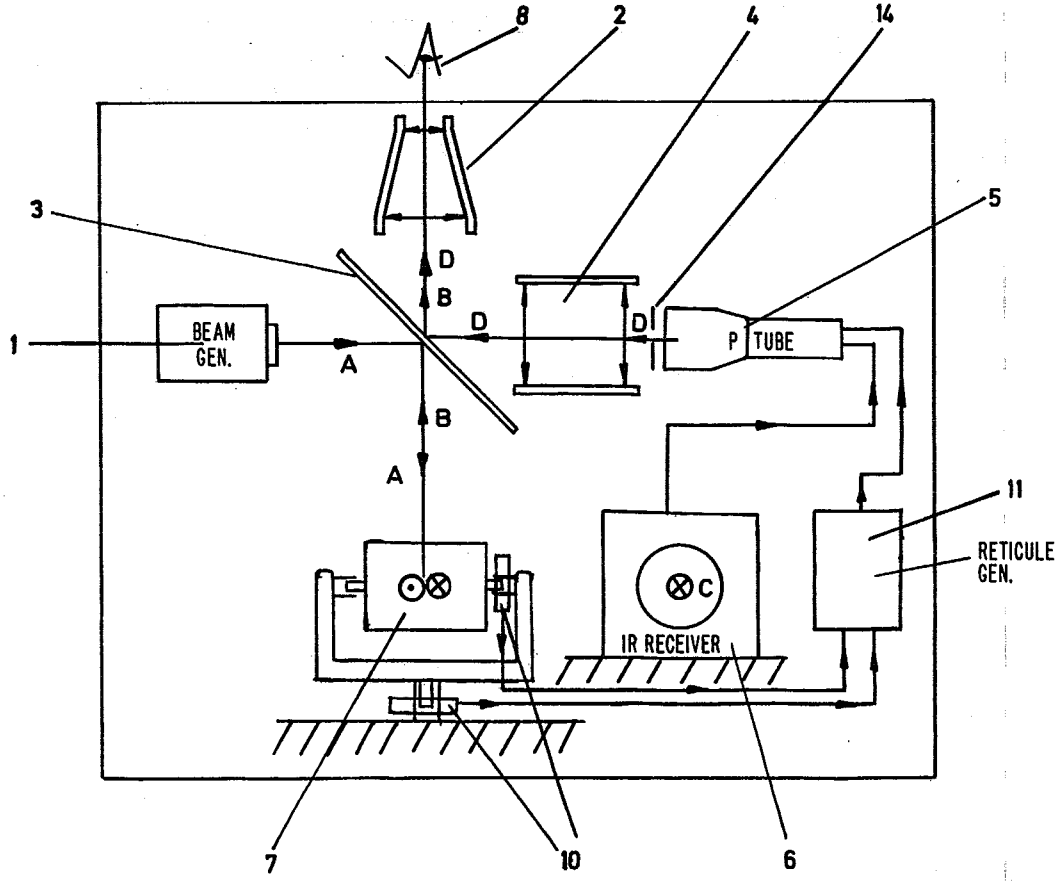
Figure 3:
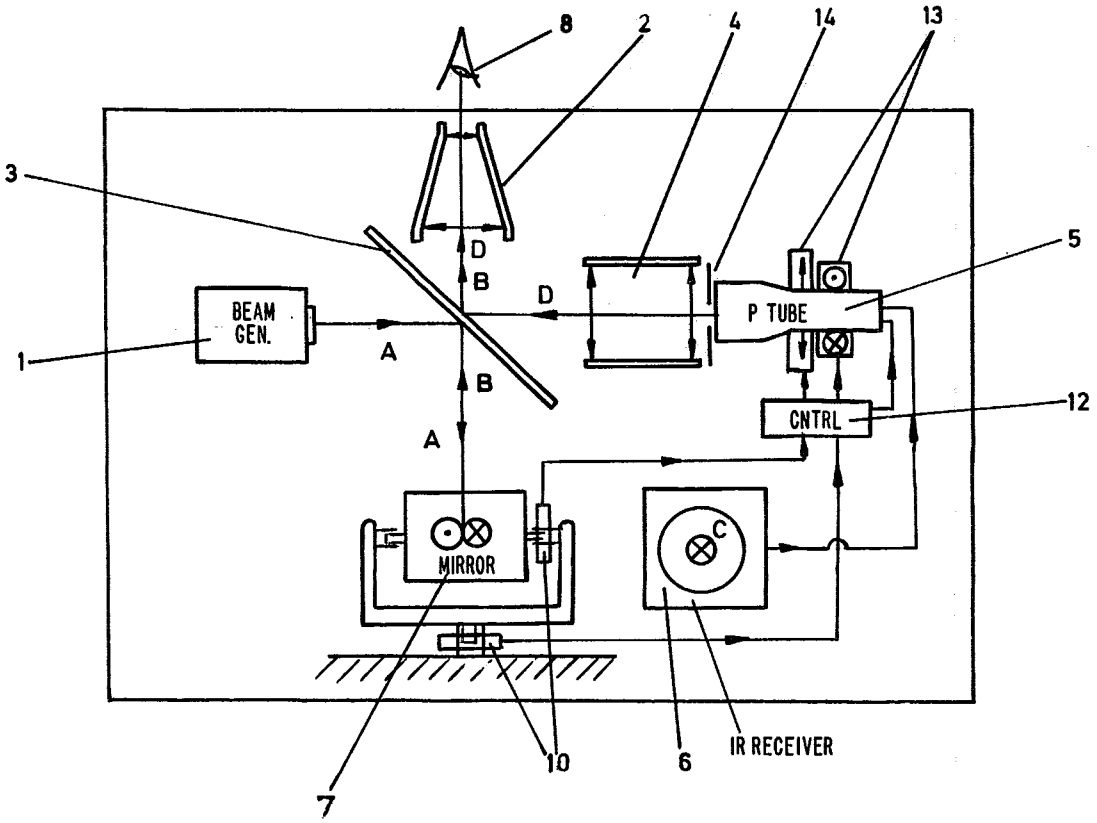

In the following, the invention will be described in more detail, with reference to the attached drawings, which as examples illustrate some various embodiments of the invention, in which FIG. 1 schematically illustrates an embodiment of the invention comprising an IR sight with an objective that can be aimed relative to the rest of the sight, FIGS. 2 and 3 schematically illustrate alternative embodiments of the invention comprising an IR sight with an objective that is fixed relative to the rest of the sight.

FIG. 1 shows a general outline of the construction of the sighting equipment which is used for guiding a missile towards a moving target. The equipment is placed in or in the vicinity of the launching site for the missile, and comprises a guidance beam generator 1 for transmission of a beam of rays A, e.g. laser radiation, in the direction towards the target. Before the beam of rays leaves the sighting equipment, a reflection first takes place against a fixed mirror 3 and thereafter against a mirror 7 which can be aimed. In order to give an operator the possibility of tracking the target, the equipment also comprises an optical sight in the form of a telescope 2 with a reticule which receives visible light B and gives an image of the target and its background in the ocular of the sight at 8. The visible light is incident against the mirror 7 that can be aimed, and is transmitted through the mirror 3 which is selective in such a way that laser light is reflected while ordinary light passes through. By turning the mirror 7 an operator can constantly keep the reticule of the telescope 2 directed on the target. The laser beam transmitted will thereby also be directed on the target if the ray paths are appropriately adjusted. From the figure it will be noted that the mirror is supported in such a way that it can be turned around a horizontal axis and also around a vertical axis.

The way in which the beam of rays transmitted from the guidance beam generator is formed does not constitute any part of the present invention, and will therefore not be described in detail. Generally speaking, it can be stated that the beam of rays consists of e.g. a predetermined geometrical pattern in the form of narrow radiation bands which sweep periodically and alternatingly over the line of sight. On the missile, a radiation detector facing rearwards is mounted, which is sensitive to the radiation in the beam of rays transmitted and generates an electric signal in dependence on the illumination by the beam of rays, which is fed to a receiver unit in the missile which is arranged to analyze the signal for determination of the position of the missile vertically and horizontally relative to the line of sight. On the basis of this position information, the control members of the missile can thereafter be actuated so that the missile is caused to follow the line of sight.

However, the part of the optical guidance beam system which is included in the missile is not comprised in the present invention, and will therefore not be described in detail either.

In order to make it possible to aim against a target even in darkness, fog or smoke, the sighting equipment also comprises an IR sight which receives the IR radiation C transmitted from the target. This radiation is incident upon another part of the mirror 7 which can be aimed, and is fed to an IR receiver 6, for conversion of the radiation into an electric signal, which is fed to a presentation tube 5 provided with a picture screen on which also an aiming symbol is generated electrically with the aid of a symbol generator 9.

The presentation equipment can also consist of a light-emitting diode display modulated by the signal from the IR sight and the symbol generator. Instead of having an electrically generated symbol, a mechanical optical reticule can also be utilized.

The IR presentation D is fed to the optical telescope 2 possibly via collection optics 4 and reflection against the selective mirror 3 so that a superposition of the objective of the optical sight takes place. This is achieved e.g. by the presentation member 5 substantially only emitting within part of the visible range and the mirror 3 reflecting the corresponding wavelengths with good effectiveness.

Adjustment of the IR sight takes place in the following way. In the ocular of the sight 2 the operator sees the IR presentation D superimposed on the objective B of the optical sight which is adjusted relative to the axis of the beam of rays. The two pictures of an optically distant object can possibly be made to coincide, but this is no requirement. With the aid of the operating members, the reticule of the IR sight is placed over the same part of the object as the one pointed out with the reticule of the optical sight. Alternatively a special test screen can be used for the adjustment, which test screen is provided with a reflector and a heat-generating element in the form of a cross or the like and is placed at a suitable distance from the sighting equipment. The sight must then also be provided with a guidance beam receiver which determines when the reflector is exactly in the middle of the guidance beam. In this case, the reticule of the IR sight is then made to coincide with the heat picture on the test screen. The reflector and the heat cross can also be placed in such a way on the test screen that the influence of parallax between different objectives is taken into consideration, and the screen can be placed relatively close to the sight.

FIG. 2 shows an alternative embodiment of the device, which comprises a fixed objective for the IR sight. In this figure, the same reference designations have been used, so that the guidance beam generator 1, the optical telescope 2 and the selective mirror 3 correspond to FIG. 1. On the other hand, in this case, the mirror 7 which can be aimed is used only to transmit the beam of rays A from the guidance beam generator 1 and to receive the visible light B from the target and its background. The objective of the IR sight is fixed and the IR radiation C from the target is received directly by the IR receiver 6, which converts the IR radiation into an electric output signal which is fed to the presentation member 5 which as in the case shown in FIG. 1 comprises a reticule which is generated electrically. The device therefore comprises a reticule generator 11 which in this case also comprises control circuits for control of the reticule on the picture screen. The control circuits receive signals from two angle transmitters 10 which are arranged at the axis of rotation of the mirror 7 and sense the position into which the mirror is turned. In this way, the aiming symbol all the time indicates the direction defined by the axis of the guidance beam, regardless of the deflection of the mirror.

In the case, adjustment of the IR sight takes place in the same way as according to FIG. 1, i.e. the image of the reticule of the IR sight is caused by the operator to point out the same part of a distant object as the reticule of the optical sight points out or, if a heat-generating and reflecting test screen is used, to coincide with the heat picture on the test screen when the axis of the guidance beam is on the reflector.

FIG. 2 also illustrates another variant of the invention which comprises a fixed objective of the IR sight. The control circuits 11 then achieve a positioning of the image of the target scene on the presentation screen. The control circuits receive signals from angle transmitters 10 on the rotatable mirror 7. In this case the image of the target scene is thus moved on the picture screen of the presentation tube relative to a fixed reticule, mechanically or electrically generated. The position of the image can be determined manually by means of control members.

FIG. 3 shows a further example of the variant of a fixed objective in the IR sight. In this case the members 12 and 13 are included for control of the presentation tube 5 itself. The members 12 then include control circuits which receive signals from angle transmitters 10 placed on the axes of the rotatable mirror 7 so that, in analogy with FIG. 2, they will sense the angle of rotation of the mirror. The control circuits are arranged so that via the members 13 they will achieve a mechanical moving of the presentation member both horizontally and vertically. The members 10, 12 and 13 can possibly be replaced by a mechanical linkage, or the mirror which can be aimed and the presentation tube can possibly also be fixed together. The IR sight can be provided with a mechanical/optical reticule 14 placed in front of the presentation member or an electrically generated reticule which is adjusted in the way previously described.

In the variants illustrated in FIGS. 1 and 2, a TV camera can be placed in position 8, and the visual objective can then be presented on a picture screen which can also be utilized for presentation of the information from the IR sight 6. The collection optics 4 can then be omitted, and the presentation tube can be placed separate from the other parts of the sight.

The invention is not limited to the embodiments shown as examples, but can also be modified within the scope of the accompanying claims. It is thus conceivable to control objects other than a missile.

The IR apparatus 6 can also or only be utilized to automatically determine the position of the target and give control signals for aiming of the mirror 7 so that the guidance beam will be on the target. No presentation on the picture screen is then required during the tracking phase.

We claim:

1. Improved missile guiding apparatus of a type wherein a guide beam of radiation is directed at a target and a missile is guided to the target by sensing the guide beam and following the beam to the target, the improvement comprising:

movable scanning means for viewing a visible light image of said target within a particular visible light field of view and directing said guide beam of radiation to a location indicated within said particular visible light field of view by a first alignment mark; and auxiliary viewing means for receiving infrared radiation from said target within a particular infrared radiation field of view and imaging said infrared radiation, including means for adjusting the position of a second alignment mark relative to the portion of said movable scanning means and the axis of said guide beam to allow said guide beam to be directed to a position defined by said second alignment mark within said infrared radiation field of view.

2. Apparatus for viewing a target and directing a guide beam of radiation at the target, comprising:

movable scanning means for viewing a visible light image of said target within a particular visible light field of view and directing said guide beam of radiation to a location indicated within said particular visible light field of view by a first alignment mark; and auxiliary viewing means for receiving non-visible radiation from said target within a particular non-visible radiation field of view and imaging said non-visible radiation, including means for adjusting the position of a second alignment mark relative to the position of said movable scanning means and the axis of said guide beam to allow said guide beam to be directed to a position defined by said second alignment mark within said non-visible radiation field of view.

3. The apparatus of claim 2 including means for generating a guide beam of infrared radiation.

4. The apparatus of claim 2 wherein said movable scanning means and said auxiliary viewing means move together to receive said visible light and said non-visible radiation and to direct said guide beam.

5. The apparatus of claim 2 including means for generating a laser guide beam.

6. The apparatus of claim 2 wherein said movable scanning means includes primary viewing means for receiving and viewing visible light images and said auxiliary viewing means includes an infrared sight having an infrared receiver for converting infrared radiation into corresponding electrical image signals, presentation means for receiving at least said electrical image signals and providing a corresponding image of said infrared radiation, and coupling means for directing a visible light image of said infrared radiation to said primary viewing means.

7. The apparatus of claim 6 wherein said auxiliary viewing means is stationary with respect to said movable scanning means and said means for adjusting the relative position of said second alignment mark includes means for positioning said second alignment mark with respect to a stationary image of the infrared radiation.

8. The apparatus of claim 6 wherein said movable scanning means includes an adjustably movable mirror for receiving infrared radiation and passing the radiation to said infrared receiver.

9. The apparatus of claim 8 wherein said means for adjusting the relative position of said second alignment mark includes angle transmitter means for generating a position signal corresponding to the position of said adjustably movable mirror and means for receiving said position signal and operating to define a corresponding relative position of said second alignment mark with respect to said image of infrared radiation.

10. The apparatus of claim 6 wherein said auxiliary viewing means is stationary with respect to said movable scanning means and said means for adjusting the relative position of said second alignment mark includes means for positioning said image of the infrared radiation with respect to said second alignment mark.

11. The apparatus of claim 6 wherein said presentation means is a cathode ray tube.

12. The apparatus of claim 11 including means for electrically generating said second alignment mark for display on said cathode ray tube.

13. The apparatus of claim 11 including means for mechanically displaying said second alignment mark relative to the image on said cathode ray tube.

14. The apparatus of claim 6 wherein said means for adjusting the relative position of said alignment mark includes symbol generating means for generating an electrical position signal defining the position of said second alignment mark with respect to said image of infrared radiation and said presentation means includes a lamp diode display for receiving said electrical image signals and said position signal and displaying a corresponding visible light image of said infrared radiation and said second alignment mark.

15. The apparatus of claim 6 wherein said coupling means includes a mirror having means for reflecting said guide beam to direct the beam and for reflecting the visible light image of said infrared radiation, said mirror passing other visible light.

16. The apparatus of claim 6 wherein said primary viewing means includes an optical sight.

* * * * *